US007555906B2

(12) United States Patent
Anichini et al.

(10) Patent No.: US 7,555,906 B2
(45) Date of Patent: Jul. 7, 2009

(54) MOUNTING SYSTEM FOR A FLAME PIPE OR LINER

(75) Inventors: Alessio Anichini, Lastra a Signa (IT); Nicola Lanese, Florence (IT); Eugenio Giorni, Gacorlo Carissimi (IT); Leonardo Tognarelli, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 444 days.

(21) Appl. No.: 10/926,399

(22) Filed: Aug. 26, 2004

(65) Prior Publication Data

US 2005/0050902 A1 Mar. 10, 2005

(30) Foreign Application Priority Data

Aug. 28, 2003 (IT) ..... M12003A1673

(51) Int. Cl.
*F02C 7/20* (2006.01)

(52) U.S. Cl. ..... 60/799; 60/798

(58) Field of Classification Search ..... 60/796, 60/800, 751, 799, 798, 752–760
See application file for complete search history.

(56) References Cited

U.S. PATENT DOCUMENTS 2,615,300 A * 10/1952 Lombard ..... 60/800
3,018,624 A * 1/1962 Bonsall et al. ..... 60/39.37
3,910,853 A * 10/1975 Kulka ..... 512/6
4,413,470 A * 11/1983 Scheihing et al. ..... 60/800
4,534,700 A * 8/1985 Horler et al. ..... 415/135
5,291,732 A * 3/1994 Halila ..... 60/796
6,116,014 A * 9/2000 Dalla Betta et al. ..... 60/777
6,910,853 B2 * 6/2005 Corman et al. ..... 415/136

FOREIGN PATENT DOCUMENTS

JP 7293276 11/1995
JP 9329337 12/1997

OTHER PUBLICATIONS

English Abstract of JP 9329337, published Dec. 22, 1997, esp@cenet database.
English Abstract of JP 7293276, published Nov. 11, 1995, esp@cenet database.

* cited by examiner

*Primary Examiner*—Michael Cuff
*Assistant Examiner*—Vikansha S Dwivedi
(74) *Attorney, Agent, or Firm*—Nixon & Vanderhye, P.C.

(57) ABSTRACT

A mounting system for a liner within a combination chamber of a gas turbine, where the liner is secured at one upstream end to a burner and at an opposite downstream end to a transition duct, the mounting system comprising:

a first elastic head comprised of a first ring-shaped housing having first and second pluralities of radially spaced, axially extending teeth, with a first annular groove between said first and second pluralities of teeth, wherein said first elastic head is secured to said upstream end of said liner, with an end portion of said liner received within said first annular groove; and a second elastic head comprised of a second ring-shaped housing having third and fourth pluralities of radially-spaced, axially-extending teeth, with a second annular groove between said third and fourth pluralities of teeth, wherein said second elastic head is secured to said downstream end of said liner, with an opposite end portion of said liner received within said second annular groove.

6 Claims, 4 Drawing Sheets

5
21
9
8
13
7

4
2
10
3
12

MOUNTING SYSTEM FOR A FLAME PIPE OR LINER

This application claims priority to IT Application No. MI2003A001673, filed 28 Aug. 2003. The entire contents of this application is incorporated herein by reference.

BACKGROUND

The present invention relates to a mounting system for a flame pipe or liner, in particular a system for mounting a flame pipe or liner inside a combustion chamber of a gas turbine with low polluting emissions.

The present invention relates to a mounting system for a flame pipe or liner, in particular a system for mounting or fixing a flame pipe or liner inside a combustion chamber of a gas turbine with low polluting emissions. As is known, gas turbines are machines consisting of a compressor and a turbine with one or more phases, wherein the compressor and turbine are connected to each other by a rotating shaft and wherein, between the compressor and the turbine, there is a combustion chamber. Air from the outside environment is fed to the compressor to bring it under pressure. The pressurized air passes through a duct, terminating with a convergent portion, inside which a series of injectors feeds fuel which is mixed with the air to form an air-fuel mixture to be burnt.

The fuel necessary for producing combustion, which causes an increase in the temperature and enthalpy of the gas, is therefore introduced into the combustion chamber by means of one or more injectors fed by a pressurized network.

Finally, the high temperature and high pressure gas reaches the various phases of the turbine, through specific ducts, which transforms the gas enthalpy into mechanical energy available for a user.

It is known that in the engineering of combustion chambers for gas turbines, the main considerations are dedicated to flame stability and control of the excess air to bring the combustion under ideal conditions and minimize the production of polluting substances. More specifically, the known art envisages the use of a flame pipe or liner inside the combustion chamber, which has two main functions. In the first place, the flame is contained inside the pipe to prevent its contact with the outer parts of the combustion chamber, in order to avoid overheating. Secondly, the pipe slows down and diffuses the flow of combustion products preventing the flame from being extinguished.

The flame pipe according to the known art is made of a metallic material, thus making it easy to fix inside the chamber and making it compatible, with respect to the tensional states generated by the thermal expansion, with the other structural components of the combustion chamber also made of metallic material. As a result of their limited mechanical characteristics under heat, however, the traditional liners or flame pipes have limits in reaching high combustion temperatures and require a high quantity of cooling air passing through them. The high quantity of cooling air required by metallic liners negatively influences the separation of the exhaust emissions.

In order to overcome these drawbacks, liners or flame pipes made of a composite material with a ceramic matrix, such as silicon carbide, have been proposed. These liners allow the following results to be obtained: an increase in the combustion temperature and consequently in the yield of gas turbines, a decrease in the cooling air in the combustion area thus facilitating the production of low emissions and, finally, an increase in the useful life of the components subjected to high temperatures. These liners or flame pipes are installed inside the combustion chamber, through sleeves made of a metallic material, situated at the ends of the liner and in turn, fixed, by means of welding or other known means, to metallic portions of the combustion chamber.

The different thermal expansion coefficient between the ceramic material and metal can, however, cause dangerous tensional states in the thermal expansion phase, which can jeopardize the resistance of the ceramic material and its duration with time. Furthermore, the fixing or mounting means so far envisaged, do not protect the ceramic material of the liner from the damaging scratching thereon of the metallic connecting portions of the combustion chamber.

BRIEF DESCRIPTION OF THE INVENTION

An objective of the present invention is therefore to provide a fixing or mounting system for flame pipes inside the combustion chamber, which overcomes the problems of traditional mounting systems.

A further objective of the present invention is to provide a mounting system which allows tensional states due to different thermal expansion coefficients between the liner and contact portions of the combustion chamber to be eliminated or in any case reduced.

Another objective of the present invention is to prevent the liner made of ceramic material from being harmfully scratched on the metallic portions of the combustion chamber.

Yet another objective of the present invention is to provide a mounting or system for liners which is simple, functional and at reduced production and maintenance costs.

These and other objectives of the present invention are achieved by providing a mounting or fixing system for a liner made of ceramic material as described further herein.

Accordingly, in one aspect, the invention relates to a mounting system for a liner within a combination chamber of a gas turbine, the liner secured at one upstream end to a burner and at an opposite downstream end to a transition duct, the mounting system comprising: a first elastic head comprised of a first ring-shaped housing having first and second pluralities of radially spaced, axially extending teeth, with a first annular groove between the first and second pluralities of teeth, wherein the first elastic head is secured to the upstream end of the liner, with an end portion of the liner received within the first annular groove; and a second elastic head comprised of a second ring-shaped housing having third and fourth pluralities of radially-spaced, axially-extending teeth, with a second annular groove between the third and fourth pluralities of teeth, wherein the second elastic head is secured to the downstream end of the liner, with an opposite end portion of the liner received within the second annular groove.

According to the present invention, the two cylindrical heads are advantageously situated, one between the burner and flame pipe and the other between the flame pipe and flow conveyor, respectively.

According to another aspect of the present invention, the cylindrical elastic heads comprise at least two parallel notches, arranged longitudinally with respect to the flame pipe, and at least one ring-shaped housing connectable to an end of the flame pipe.

According to another aspect of the present invention, the cylindrical elastic heads comprise first circumferential springs situated inside the ring-shaped housing.

The characteristics and advantages of a mounting system for a flame pipe or liner according to the present invention, will appear more evident from the following illustrative and non-limiting description referring to the schematic drawings identified below:

DETAILED DESCRIPTION OF THE INVENTION

Figures 1, 5:
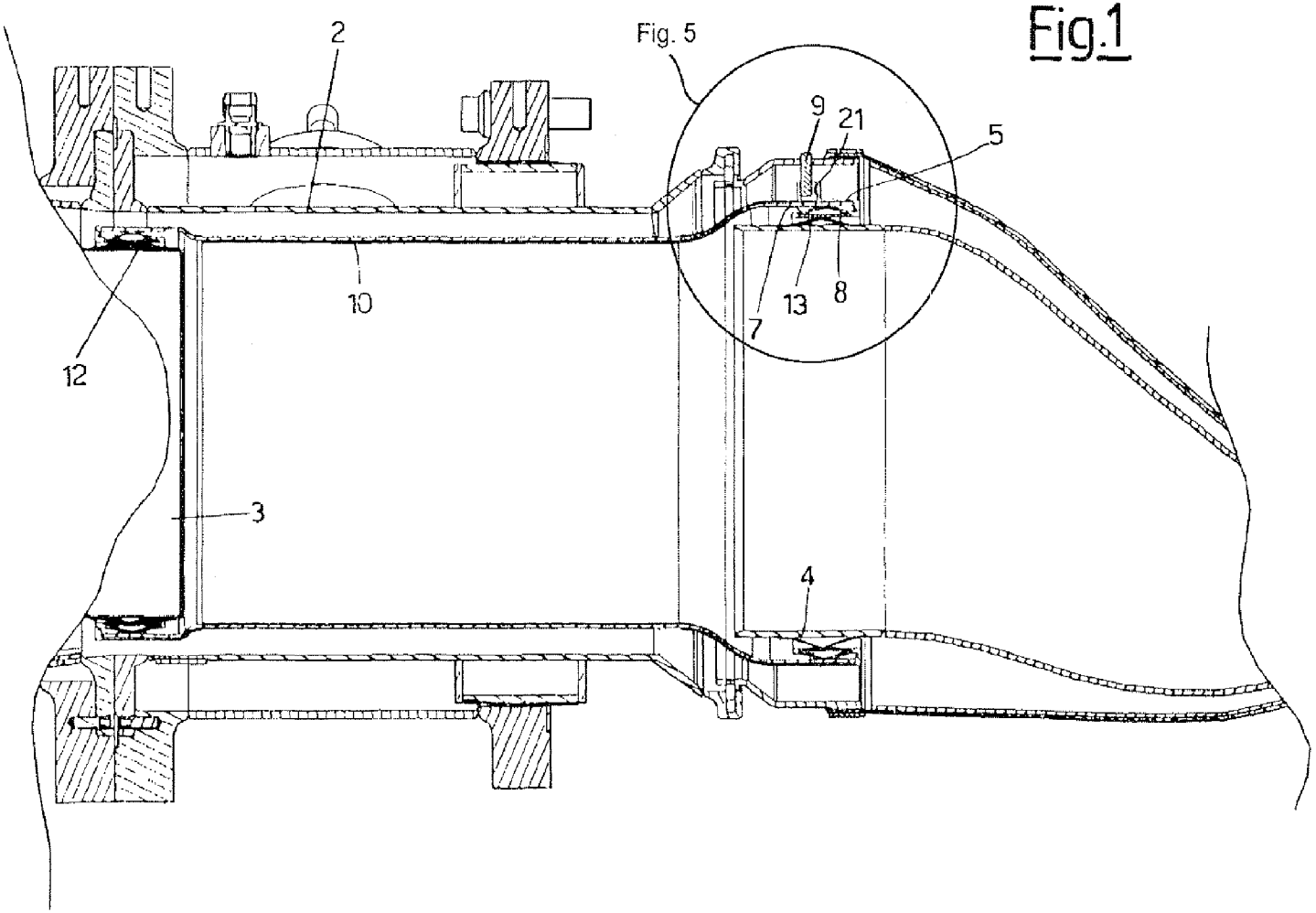
FIG. 1 is a longitudinal sectional view of a flame pipe or liner fixed in a combustion chamber for gas turbines with the mounting system according to the present invention.
FIG. 5 is an enlarged detail taken from FIG. 1.
Figure 2:
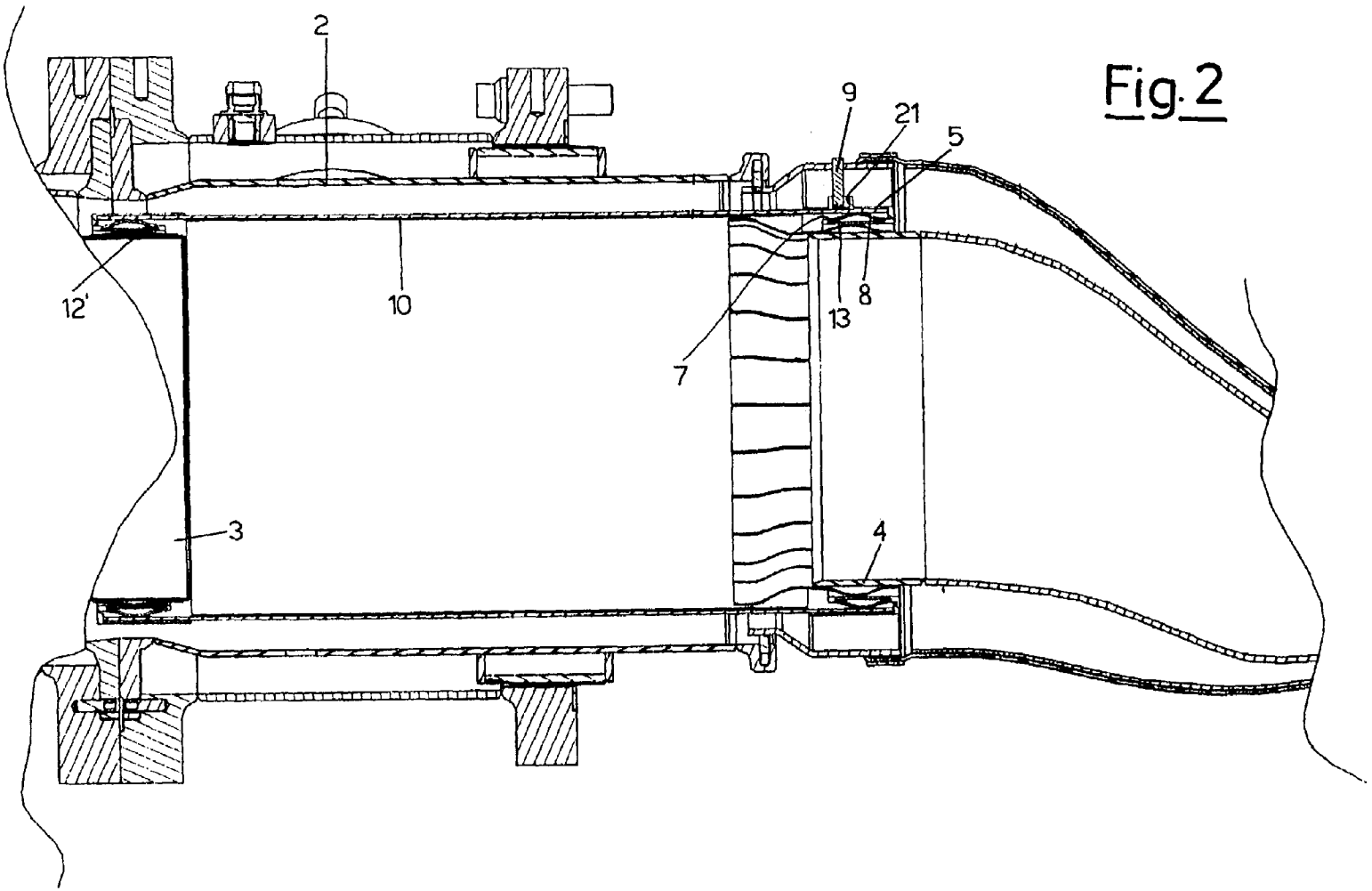
FIG. 2 is a longitudinal sectional view of an alternative embodiment of a flame pipe or liner according to the present invention.

With reference to FIGS. 1 and 2, there is shown a combustion chamber 2 of a gas turbine, inside which a flame pipe or liner 10, according to the present invention, is mounted. The flame pipe 10 has a cylindrical structure and is connected at one of its ends to the burner 3 and at the other end to a flow connector or conveyor 4 for the turbine.

More specifically, in order to allow an increase in the internal combustion temperature, the flame pipe 10 is made of a composite material with a ceramic matrix, and preferably made of silicon carbide.

The installation of a flame pipe or liner 10 made of composite material, such as that described above, requires a specific mounting system suitable for allowing the liner 10 to thermally expand without creating tensional states which could jeopardize the resistance of the ceramic material and its duration over a period of time. The mounting system must also eliminate harmful scratching between the ceramic material and the metallic components of the combustion chamber 2.

For this purpose, the mounting system incorporates two cylindrical elastic heads 5 whose dimensions are such as to allow them to be frictionally engaged, as shown in FIGS. 1, 2 and 5, onto the opposite ends of the liner 10.

In particular, the cylindrical elastic heads 5 are wedged onto the opposite ends of the liner 10 thanks to appropriate ring-shaped housings provided with grooves 7 whose size corresponds to that of the end of the liner 1 on which they are inserted, in combination with springs 8 described further below.

Figure 3:
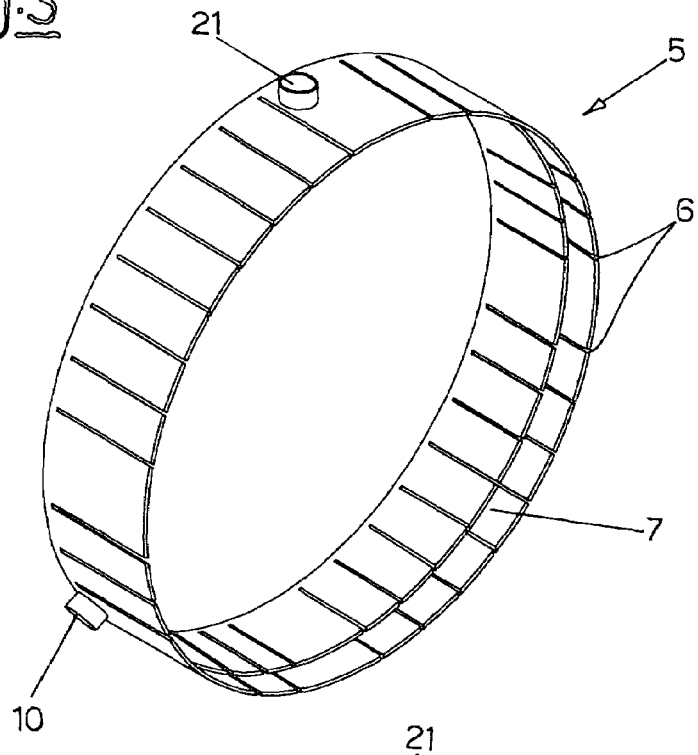
FIG. 3 is a perspective view of a cylindrical elastic head according to the present invention.
Figure 4:
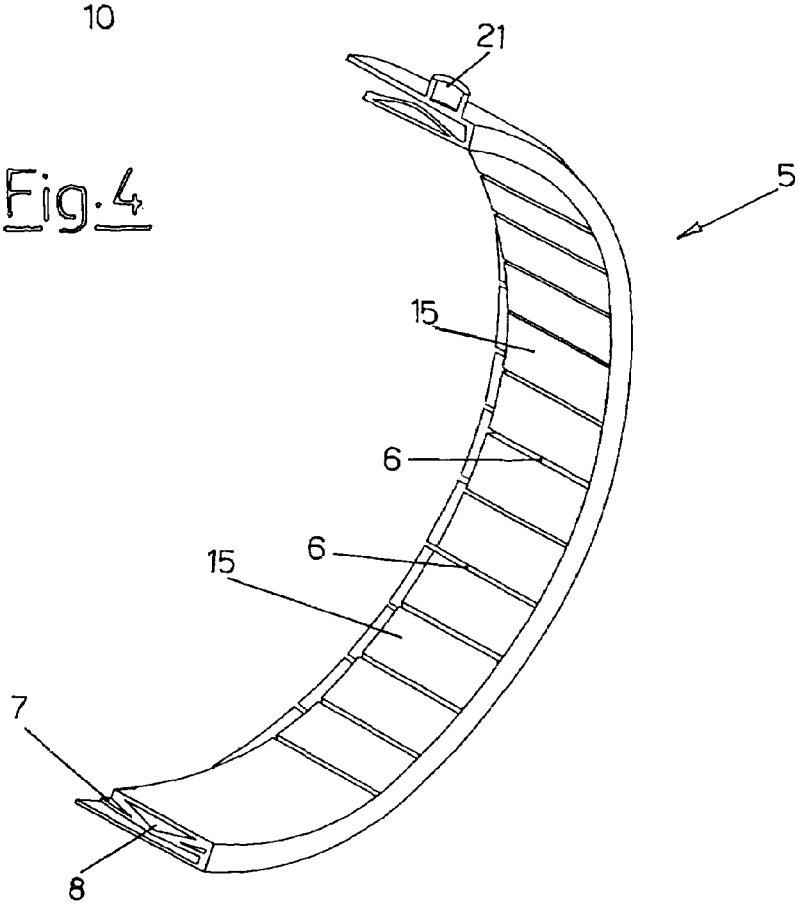
FIG. 4 shows another partially sectional perspective view of the cylindrical elastic head of FIG. 3.
Figure 5:
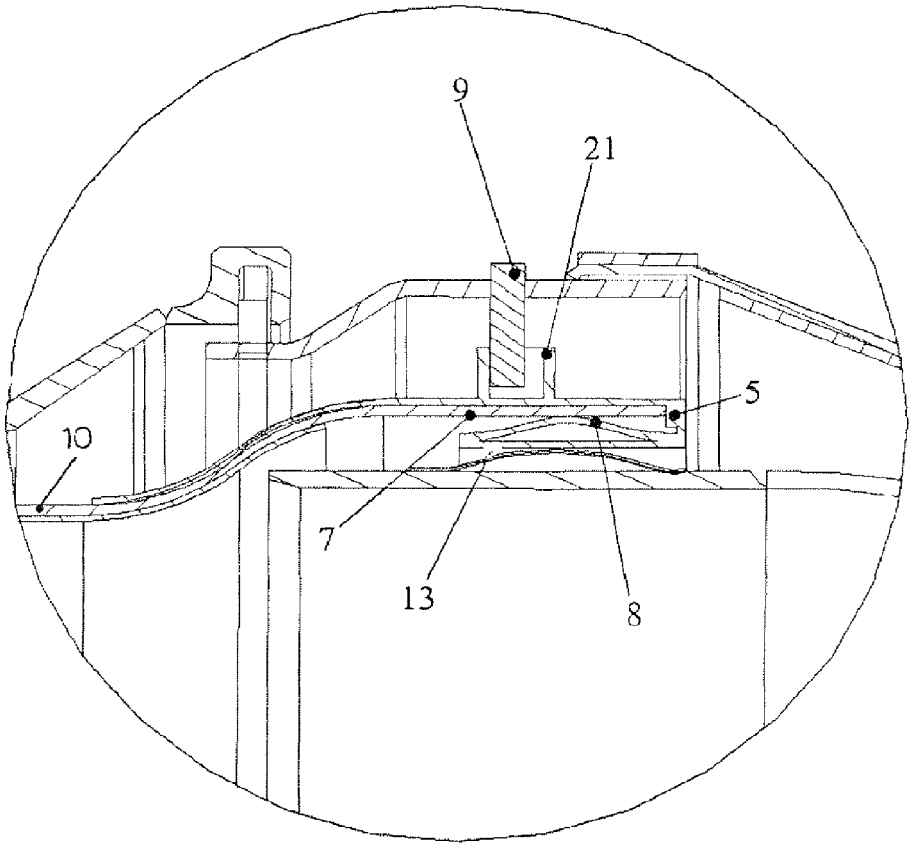

The two cylindrical elastic heads 5, normally made of a metallic material, include radially inner and outer walls 5A and SB, each formed along their circumference, as shown in FIGS. 3 and 4, with a series of notches 6 arranged in parallel to define first and second series of teeth 15A and 15B. The radially spaced walls 5A and SB form the groove 7 in which the end of the liner 10 is received, while the notches 6 allow the expansion of the liner 10, in a radial direction.

Spikes or beads 9 which fit into pass-through radial holes 21 of the heads 5 are provided for locking the heads 5 onto the liner 10, in order to prevent an angular sliding between the heads 5 and liner 10.

The cylindrical elastic heads 5, more clearly visible in FIGS. 3, 4 and 5, are each equipped with a cylindrical spring 8 capable of attenuating, during the thermal expansion, the tensions due to the different material between the metallic head 5 and ceramic matrix liner 10, and exerting pressure on the internal surface of the liner 10, capable of locking the heads 5 on the liner 10.

More specifically, there is a cylindrical elastic spring 8 for each head 5, situated inside the ring-shaped housing grooves 7, which protrudes on the internal surface of the liner 10. The spring 8 is produced as a part of an internal surface of the housing.

In order to avoid scratching in an axial direction between the liner 10 of composite material with a ceramic matrix and the connecting metallic components of the combustion chamber, such as the flow conveyor or transition duct 4 and burner 3, the mounting means comprise third and fourth cylindrical springs 12, 13.

More specifically, the cylindrical spring 12 is situated in correspondence with an end of the liner 10, between the burner 3 and the liner 10, so as to rest, in order to exert its fixing action, on the outer surface of the cylindrical head 5, creating a metal-metal contact.

The other cylindrical spring 13, on the other hand, is situated in correspondence with the other end of the liner 10, between the flow conveyor 4 and the liner 10, so as to rest, in order to exert its fixing action, on the outer surface of the cylindrical head 5, also in this case creating a metal-metal contact.

FIG. 2 illustrates an alternative embodiment of the flame pipe or liner 10 according to the present invention completely analogous to that described above, except for the fact that it has a section with a constant diameter and requires, for fixing it onto the flow conveyor 4, a particular cylindrical spring 13' with a sinusoidal profile.

The description clearly indicates the characteristics of an improved mounting or fixing system for a flame pipe or liner within a combustion chamber of a gas turbine with low polluting emissions which provides advantages, among which are:

possibility of installing liners made of composite material having a different thermal expansion coefficient with respect to the combustion chamber;

attenuation of the tensional states;

elimination of harmful scratching between the connection parts of the combustion chamber and the liner made of ceramic material;

simple and reliable use;

relatively low production and maintenance costs, with respect to the known art.

Finally, numerous modifications and variations can obviously be applied to the fixing system thus conceived, all included within the scope of the invention. Furthermore, all the details can be substituted by technically equivalent elements. In practice, the materials used, as also the forms and dimensions can vary according to the technical demands which arise in specific applications.

The invention claimed is:

1. A mounting system for a liner within a combustion chamber of a gas turbine, the liner secured at one upstream end to a burner and at an opposite downstream end to a transition duct, the mounting system comprising:

a first elastic head comprised of a first ring-shaped housing having first and second pluralities of radially spaced, axially extending teeth, with a first annular groove between said first and second pluralities of teeth, wherein said upstream end of said liner is received within said first annular groove; and a second elastic head comprised of a second ring-shaped housing having third and fourth pluralities of radially-spaced, axially-extending teeth, with a second annular groove between said third and fourth pluralities of teeth, wherein said downstream end of said liner is received within said second annular groove.

2. The mounting system of claim 1 wherein said first and second annular grooves are provided with respective first and second annular, elastic springs biasing said upstream and downstream ends of said liner, respectively, in a radial direction within said first and second annular grooves.

3. The mounting system of claim 1 wherein said burner is received within said first elastic head and wherein a third annular spring is radially interposed between said first elastic head and said burner.

4. The mounting system of claim 3 wherein said transition duct is received within said second elastic head, and wherein a fourth annular spring is radially interposed between said second elastic head and said transition duct.

5. The mounting system of claim 1 wherein at least one of said first and second ring shaped housings are provided with at least one radial hole adapted to receive a radially projecting spike to prevent angular sliding movement between the liner and a respective one of the burner and transition duct.

6. The mounting system of claim 3 wherein said fourth spring has a sinusoidal shape.

* * * * *

UNITED STATES PATENT AND TRADEMARK OFFICE

CERTIFICATE OF CORRECTION

PATENT NO. : 7,555,906 B2
APPLICATION NO. : 10/926399
DATED : July 7, 2009
INVENTOR(S) : A. Anichini et al.

It is certified that error appears in the above-identified patent and that said Letters Patent is hereby corrected as shown below:

At column 3, lines 54 and 57, delete "SB" and insert --5B--

Signed and Sealed this

Twenty-ninth Day of September, 2009

David J. Kappos

David J. Kappos
*Director of the United States Patent and Trademark Office*